US007021371B2

(12) United States Patent
Saito et al.

(10) Patent No.: US 7,021,371 B2
(45) **Date of Patent: *Apr. 4, 2006**

(54) HEAT EXCHANGER

(75) Inventors: Katsuhiro Saito, Nishi-Kasugai-gun (JP); Masashi Inoue, Nishi-Kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/977,426

(22) Filed: Oct. 16, 2001

(65) Prior Publication Data

US 2002/0043361 A1 Apr. 18, 2002

(30) Foreign Application Priority Data

Oct. 18, 2000 (JP) ..... P2000-318443

(51) Int. Cl.
*F28D 1/03* (2006.01)
*F28F 9/22* (2006.01)

(52) U.S. Cl. ..... 165/153; 165/174; 165/176

(58) Field of Classification Search ..... 165/153, 165/176, 174, 166

See application file for complete search history.

(56) References Cited

U.S. PATENT DOCUMENTS 4,153,106 A * 5/1979 Sonoda et al. ..... 165/174
4,621,685 A * 11/1986 Nozawa ..... 165/153
4,809,518 A * 3/1989 Murayama ..... 62/225
5,284,203 A * 2/1994 Dauvergne ..... 165/174
5,651,268 A * 7/1997 Aikawa et al. ..... 165/174
5,680,773 A * 10/1997 Aikawa et al. ..... 165/153
5,701,760 A * 12/1997 Torigoe et al. ..... 165/153
5,735,343 A * 4/1998 Kajikawa et al. ..... 165/153
5,806,586 A * 9/1998 Osthues et al. ..... 165/174
5,906,237 A * 5/1999 Aikawa ..... 165/153
6,179,051 B1 * 1/2001 Ayub ..... 165/174

(Continued)

FOREIGN PATENT DOCUMENTS

JP 03031694 A * 2/1991 ..... 165/166
JP 9-33138 2/1997

OTHER PUBLICATIONS

U.S. Appl. No. 09/900,947, filed Jul. 10, 2001, Pending.

(Continued)

*Primary Examiner*—Leonard R. Leo
(74) *Attorney, Agent, or Firm*—Oblon, Spivak, McClelland, Maier & Neustadt, P.C.

(57) ABSTRACT

The invention has as an object providing a two-block heat exchanger that can improve the heat exchange capacity by distributing the refrigerant evenly in the refrigerant path. The invention is a two-block heat exchanger, and the refrigerant distribution part provides two separate refrigerant paths R1 and R2 through which the refrigerant flows and an opening provided at both of the respective ends of these refrigerant paths R1 and R1. Among the two refrigerant paths R1 and R2, the open end of the space Sout 1 (refrigerant circulation space) on the exit side formed by the one opening of the one refrigerant path R1 is connected to the open end of the space Sin 2 (refrigerant circulation space) on the entrance side formed by one opening of the other refrigerant path R2. After the refrigerant flows into the refrigerant path R1 of each refrigerant distribution part, and refrigerant flows through the refrigerant path R2 of each of the refrigerant distribution parts.

3 Claims, 7 Drawing Sheets

U.S. PATENT DOCUMENTS

| | | | | |
|---|---|---|---|---|
| 6,220,342 | B1 * | 4/2001 | Nishishita et al. | 165/174 |
| 6,397,938 | B1 * | 6/2002 | Nishishita | 165/153 |
| 6,453,989 | B1 * | 9/2002 | Watanabe et al. | |
| 6,470,964 | B1 * | 10/2002 | Nakado et al. | |
| 6,491,092 | B1 * | 12/2002 | Nakado et al. | 165/152 |

OTHER PUBLICATIONS

U.S. Appl. No. 09/948,648, filed Sep. 10, 2001, Pending.
U.S. Appl. No. 09/948,773, filed Sep. 10, 2001, Pending.
U.S. Appl. No. 09/956,874, filed Sep. 21, 2001, Pending.

* cited by examiner

HEAT EXCHANGER

BACKGROUND OF THE INVENTION

1. Field of the Invention

The present invention relates to a heat exchanger mounted on an air conditioning device and the like.

2. Description of the Related Art

FIG. 9 shows an example of a two-block heat exchanger used as an evaporator in an automobile air conditioning system and the like. The heat exchanger shown in the figure is referred to as a drawn cup type, and is formed by plate-shaped refrigerant distribution parts 3 comprising overlapping rectangular plates 1 and 2 that have had a drawing process carried out thereon and cooling fins 4 bent into an wave shape being alternately layered.

In the refrigerant distribution parts 3, the periphery and center of the plates 1 and 2 are brazed, and thereby a U-shaped refrigerant path R is formed that goes from the refrigerant entrance 5 provided at the top, descending to and returning from the bottom for discharge into the refrigerant exit 6 provided at the top and arranged next to the refrigerant entrance.

In this heat exchanger, the refrigerant is distributed among each of the refrigerant distribution parts 3 in the refrigerant entrance 5, is evaporated in the process of flowing through in the refrigerant paths R, merges together again in the refrigerant exit 6, and flows out of the heat exchanger.

However, problems such as the following can be pointed out concerning the heat exchanger having the structure described above.

Specifically, as shown in FIG. 10, a continuous space T (below referred to as a tank) is formed by the layering of refrigerant entrances 5, and the refrigerant flowing into the heat exchanger is distributed to each of the refrigerant distribution parts 3 in the process of progressing through this continuous space in the direction of the arrows in the figure. However, in the conventional heat exchanger, the refrigerant supplied to the tank T passes with difficulty to the back of the tank T and there is a tendency for much of the refrigerant to flow through the upstream side of the refrigerant paths R. Thus, the flow of the refrigerant stagnates in the downstream side of the tank T. Due to this, the distribution of refrigerant to each of the refrigerant distribution parts 3 cannot be carried out uniformly, and at the refrigerant path R of the tank T positioned downstream, the refrigerant becomes hot, and the heat exchange cannot be sufficiently carried out.

In consideration of the problem described above, it is an object of the present invention to provide a heat exchanger that can realize an improvement in the heat exchange capacity by evenly distributing the refrigerant in the refrigerant paths.

SUMMARY OF THE INVENTION

A first aspect of the present invention is characterized in a heat exchanger being a two-block heat exchanger formed by a plate shaped refrigerant distribution part having overlapped two plates that have been drawing processed and providing a refrigerant path inside alternatively layered with a refrigerant fin, openings that open into the refrigerant paths formed respectively in each of the two plates, and a continuous refrigerant circulation space formed by abutting the openings of the adjacent refrigerant distribution part that are layered, wherein: the refrigerant distribution part provides two separate refrigerant paths through which the refrigerant flows and the openings provided at both respective ends of these refrigerant paths; and one end of each of the refrigerant circulating spaces is a closed end that is closed off and the other end is an open end that is opened, and among the two refrigerant paths, the open end of the refrigerant circulation space formed by the one open part of the one refrigerant path is connected to the open end of the refrigerant circulation space formed by the one open part of the other refrigerant path.

In the present invention, in the two-block heat exchanger in which each refrigerant distribution part has a two-row refrigerant path, once the refrigerant that flows through one of the refrigerant paths flows out into the refrigerant circulation space, subsequently, it flows through the other refrigerant path. In this manner, because the refrigerant flows though each of the two refrigerant paths, the stagnation of the refrigerant is prevented, and heating occurs with difficulty.

In a second aspect of the present invention, a heat exchanger according to the first aspect has a refrigerant distribution means that adjusts the amount of refrigerant supplied to the refrigerant path provided on at least one of the refrigerant circulation spaces.

In this heat exchanger, because the amount of refrigerant flowing into each refrigerant path is controlled by the refrigerant distribution means, the uniformity is further improved.

DETAILED DESCRIPTION OF THE INVENTION

Next, the preferred embodiments of the present invention will be explained referring to the figures.

Figure 1:
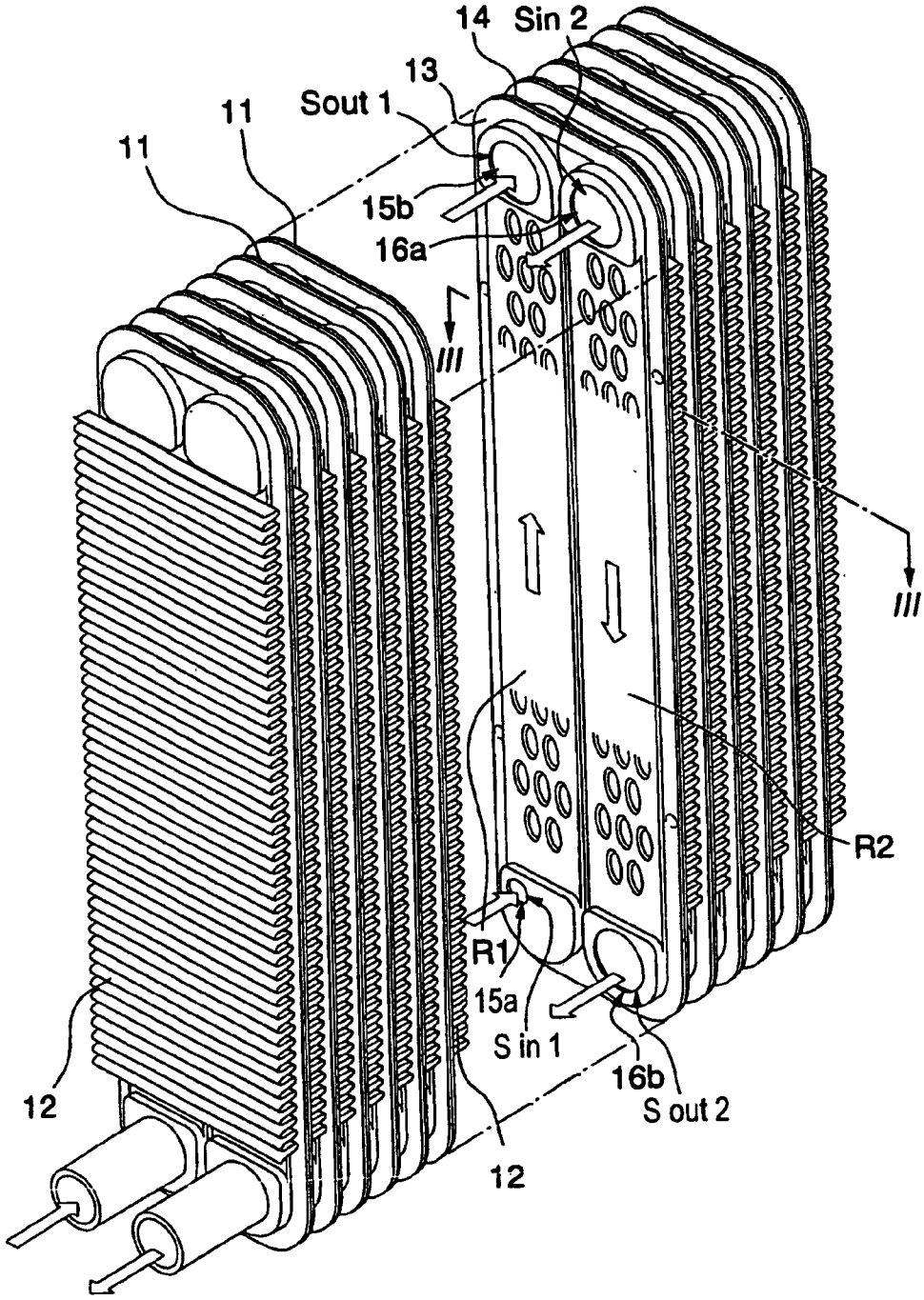
FIG. 1 is a perspective drawing showing an embodiment of the heat exchanger according to the present invention.
Figure 2:
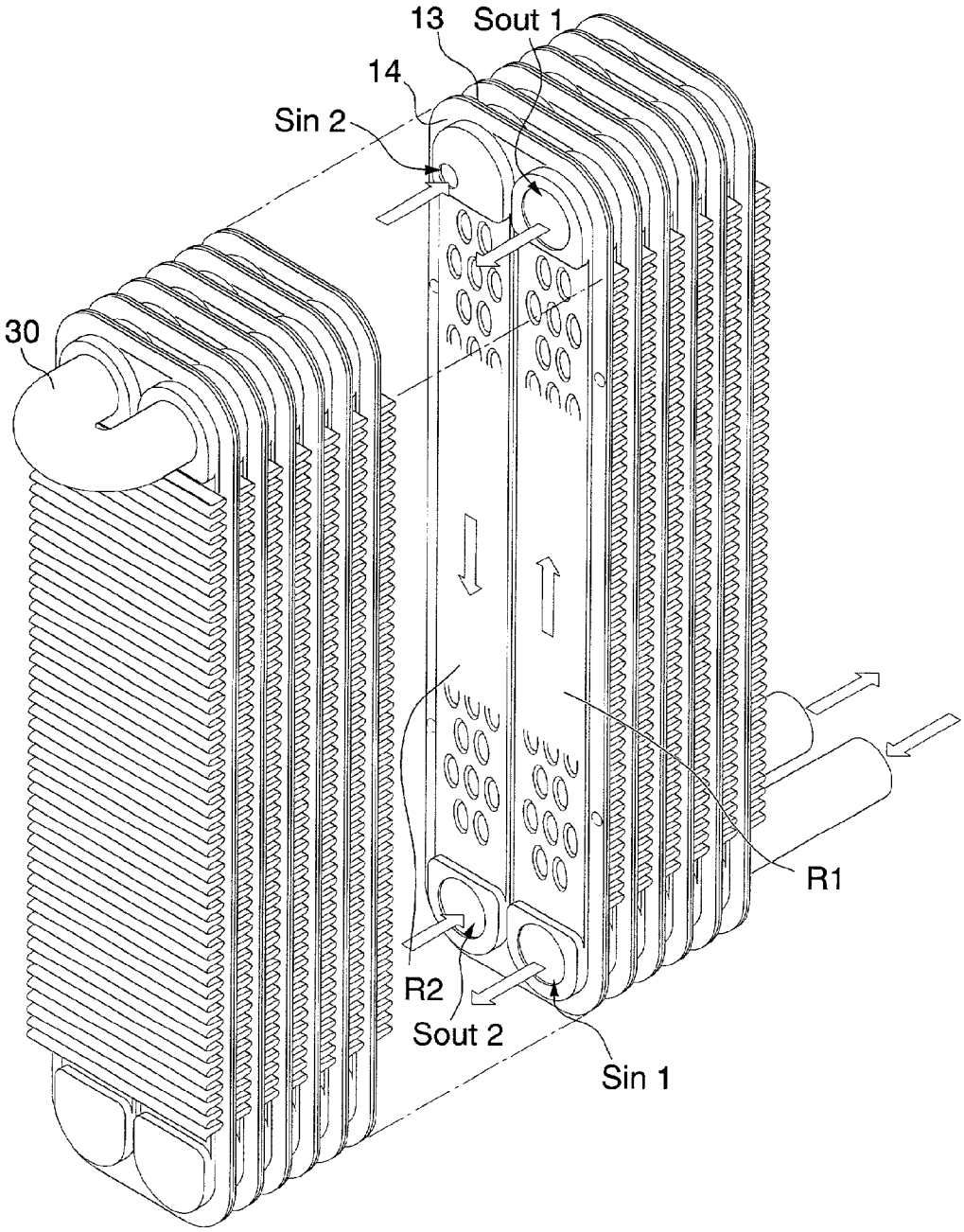
FIG. 2 is a perspective drawing viewing the same heat exchanger from the back.

The heat exchanger shown in FIG. 1 is formed by a plate shaped refrigerant distribution part 11 and a wave shaped refrigerant fin 12 being alternatively layered. FIG. 2 is a perspective drawing of the heat exchanger seen from the back side.

Figure 5:
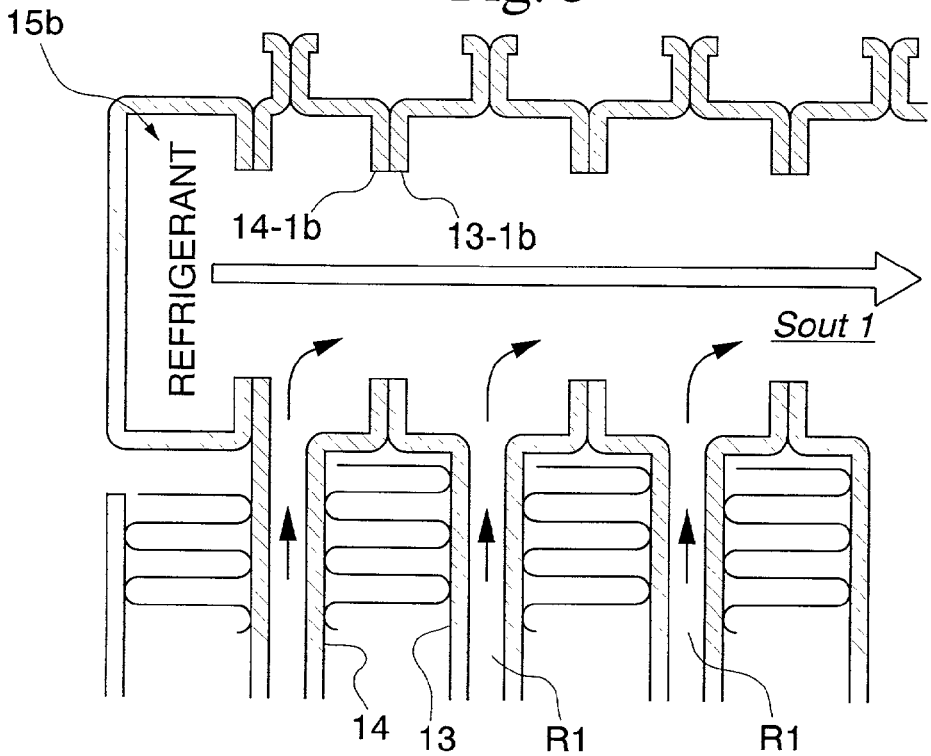
FIG. 5 is a cross-sectional drawing showing the space at the exit side and the refrigerant path connected thereto.

As also shown in FIG. 5, the refrigerant distribution part 11 comprises substantially rectangular plates 13 and 14, which have been drawing processed, being layered and brazed at the periphery and center. In the refrigerant distribution part 11, independent refrigerant paths R1 and R2 through which the refrigerant flows are provided next to each other. In the lower part, the refrigerant entrance 15*a* and the refrigerant exit 16*b* of the refrigerant paths R1 and R2 are provided next to each other. In the upper part, refrigerant exit 15*b* and refrigerant entrance 16*a* of the respective refrigerant paths R1 and R2 are provided next to each other.

In the refrigerant distribution part 11, the plates 13 and 14 that form the refrigerant paths R1 and R2 are recessed from the outside to form a plurality of dimples 17, and a plurality of bulge parts 18 are formed in the refrigerant paths R1 and R2 by these dimples 17. Moreover, inner fins can be sandwiched between the plates 13 and 14 to form the refrigerant paths R1 and R2 as well.

Figure 3:
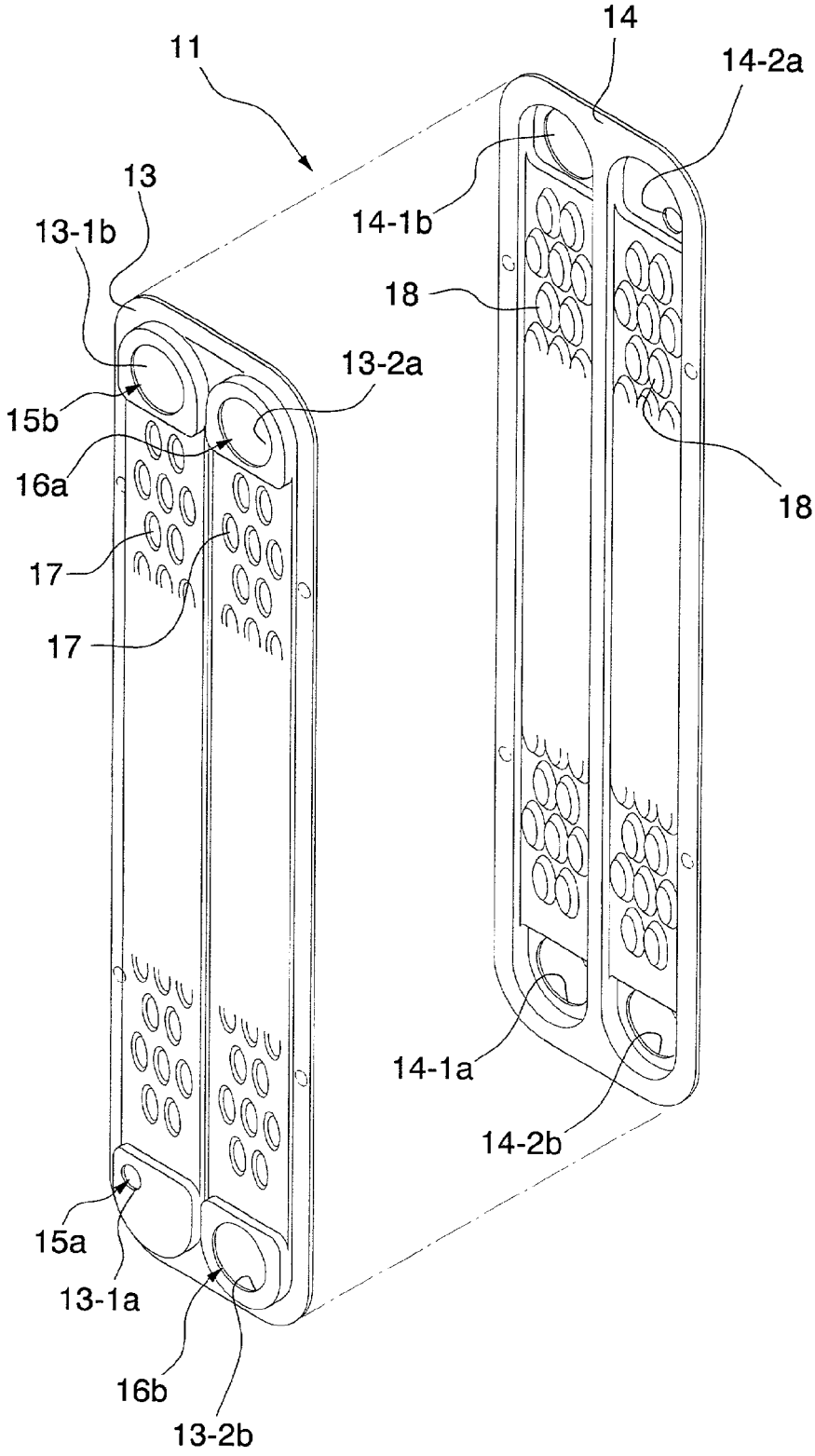
FIG. 3 is an exploded perspective drawing showing the refrigerant distribution part that forms the heat exchanger in FIG. 1.
Figure 4:
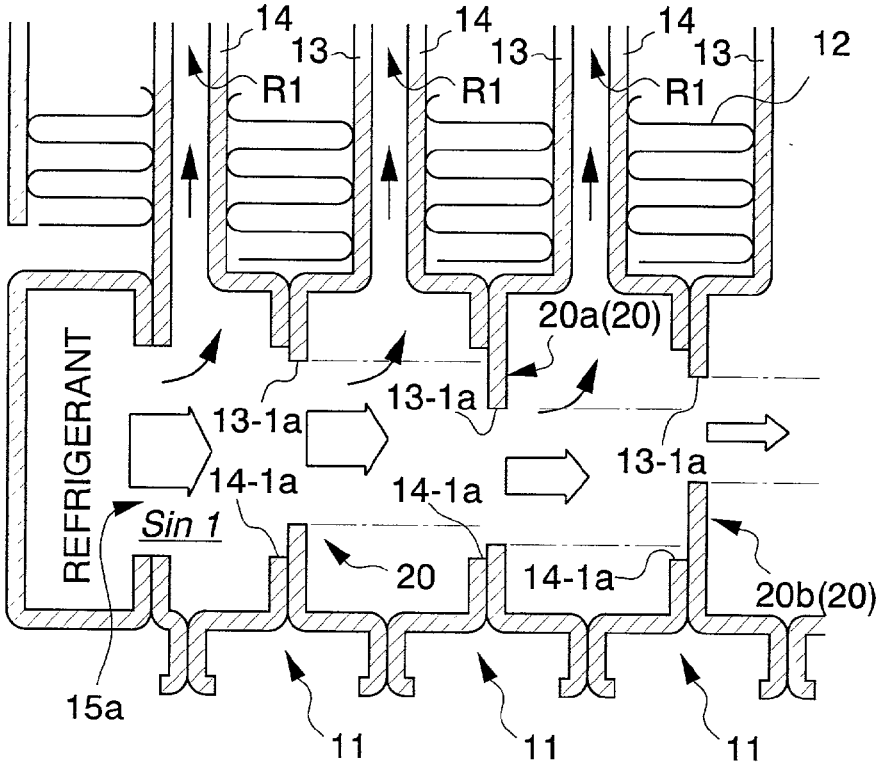
FIG. 4 is a cross-sectional drawing showing the space at the entrance side and the refrigerant path connected thereto.

As shown in FIG. 3, the refrigerant entrance 15*a* comprises openings 13-1*a* and 14-1*a* formed in the plates 13 and 14, and as shown in FIG. 4, the refrigerant entrances 15*a* provided on each of the refrigerant distribution parts 11 form a continuous space Sin 1 (the refrigerant circulation space) on the entrance side by abutting without sandwiching the refrigerant fin 12. Similarly, the refrigerant exit 15*b* comprises openings 13-1*b* and 14-1*b* formed in the plates 13 and 14, and as shown in FIG. 5, the refrigerant exit 15*b* provided on each of the refrigerant distribution parts 11 forms a continuous space Sout 1 (refrigerant circulation space) on the exit side by abutting without sandwiching the refrigerant fin 12.

Although not illustrated, similarly, the refrigerant entrance 16*a* comprises the openings 13-2*a* and 14-2*a* formed in the plates 13 and 14 and forms the space Sin 2 (the refrigerant circulation space) on the entrance side, and the refrigerant exit 16*b* comprises the openings 13-2*b* and 14-2*b* formed in plates 13 and 14, and forms the space Sout 2 (refrigerant circulation space) on the exit side (refer to FIG. 1).

Specifically, in the refrigerant distribution part 11, the space Sin 1 on the entrance side and the space Sout 2 on the exit side are respectively positioned adjacent to the space Sout 1 on the exit side and space Sin 2 on the exit side. In addition, as shown in FIG. 1, one end of the space Sout 1 on the exit side and space Sin 2 on the entrance side is closed off, and the other end shown in FIG. 2 is connected by the communicating path 30.

In the heat exchanger having the structure described above, the refrigerant is distributed in each of the refrigerant distribution parts 11 by the process of progressing through the space Sin 1 on the entrance side in the direction of the arrow shown in the figure, is evaporated by the process of flowing through each of the refrigerant paths R1, and merged in the space Sout 1 on the exit side. Next, passing through the communicating path 30, the refrigerant progresses through the space Sin 2 on the entrance side in the direction opposite to that of the space Sout 1 on the exit side, and by this process, the refrigerant is distributed to each of the refrigerant distribution parts 11, further evaporated by a process of flowing through each of the refrigerant paths R2, and again merges and flows into the space Sout on 2 the exit side.

However, as can be understood from FIG. 3, the opening 13-1*a* in the plate 13 that forms the refrigerant entrance 15*a* is formed smaller than the opening 14-1*a* of the plate 14 that similarly acts as the refrigerant entrance 15*a*. Further, as shown in FIG. 4, an opening 14-1*a* is formed at the same position in each of the refrigerant distribution paths 11, but the openings 13-1*a* are formed at respectively differing positions in each of the refrigerant distribution parts 11. This means that because the refrigerant distribution part 11 is layered, the part that forms the opening 13-1*a* provides a function as an baffle plate (a cooling distribution means) that prevents flow of the refrigerant to the opening 14-1*a* forming the refrigerant entrance 15*a*, and the opening 13-1*a* is provided on the adjacent baffle plate 20 and disposed so as not to overlap in the direction of flow of the refrigerant.

Moreover, although omitted in the figures, the opening 14-2*a* of the plate 14 forming the refrigerant entrance 16*a* is structured similarly (refer to FIG. 3). Below, the space Sin 1 on the entrance side will be explained, but the explanation is similar for the space Sin 2 on the entrance side as well.

In this heat exchanger, the refrigerant that flows through the space Sin 1 on the entrance side flows downstream while passing through the openings 13-1*a* formed by each of the baffle plates 20, and the refrigerant that cannot pass through the opening 13-1*a* is guided by the baffle plates 20 to flow into the refrigerant path R1.

Furthermore, because the opening 13-1*a* is disposed so as not to overlap the adjacent baffle plates 20 that are provided, a part of the refrigerant that passes, for example, through the opening 13-1*a* of the baffle plate 20*a* on the upstream side cannot pass through the opening 13-1*a* because the flow is blocked by the baffle plate 20*b* when flowing through the opening 13-1*a* of the adjacent baffle plate 20*b*.

In this manner, because the opening 13-1*a* provided in the adjacent baffle plate 20 is disposed so as not to overlap each other, much refrigerant is distributed to the refrigerant distribution part 11, where refrigerant tended to stagnate, and each of the refrigerant distribution parts 11 provided in plurality can distribute the refrigerant uniformly.

Figure 6:
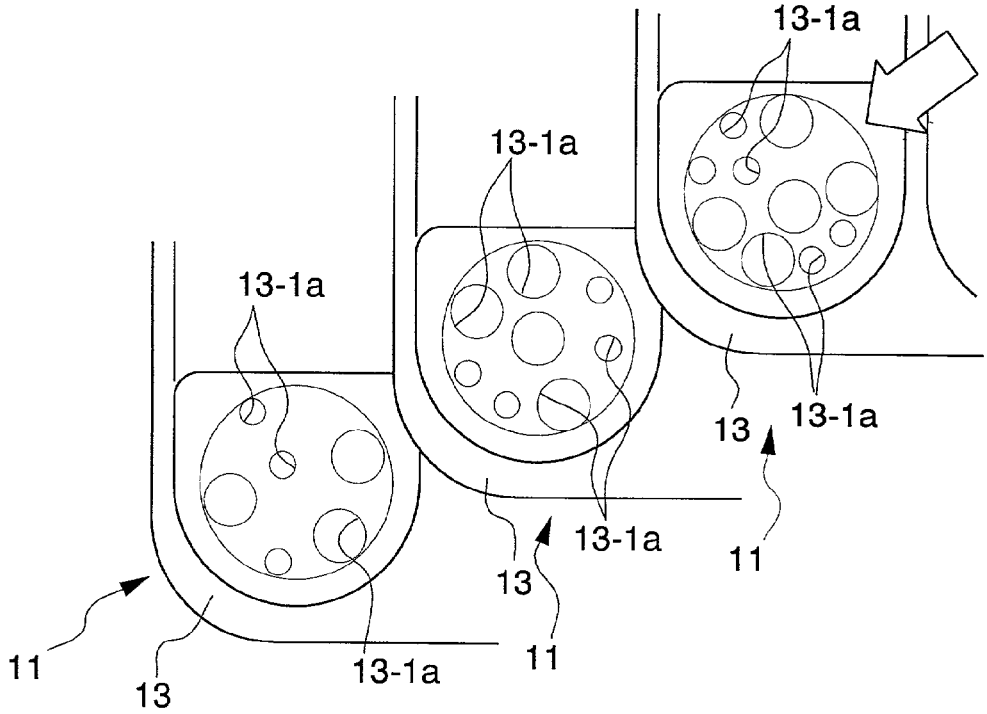
FIG. 6 is a drawing showing an embodiment similar to this same heat exchanger, and is a time sequence drawing formed at each baffle plate.

Moreover, the number of openings 13-1*a* formed in each baffle plate 20 is not limited to one, but for example, as shown in FIG. 6, may be provided in plurality, and furthermore, the size of each of the openings 13-1*a* can be respectively formed so as to be different.

In addition, the baffle plates 20 can also be provided on the plate 14 side.

Furthermore, baffle plates 20 do not need to be formed on all of the plates 13 (14), and only need to be provided on one among the spaces Sin 1 and Sin 2 on the entrance side.

Moreover, as an example of a modification, the structure described below is possible. Moreover, in the following as well, only the space Sin 1 on the entrance side will be explained, but the explanation for the space Sin 2 on the entrance side is similar.

Figure 7:
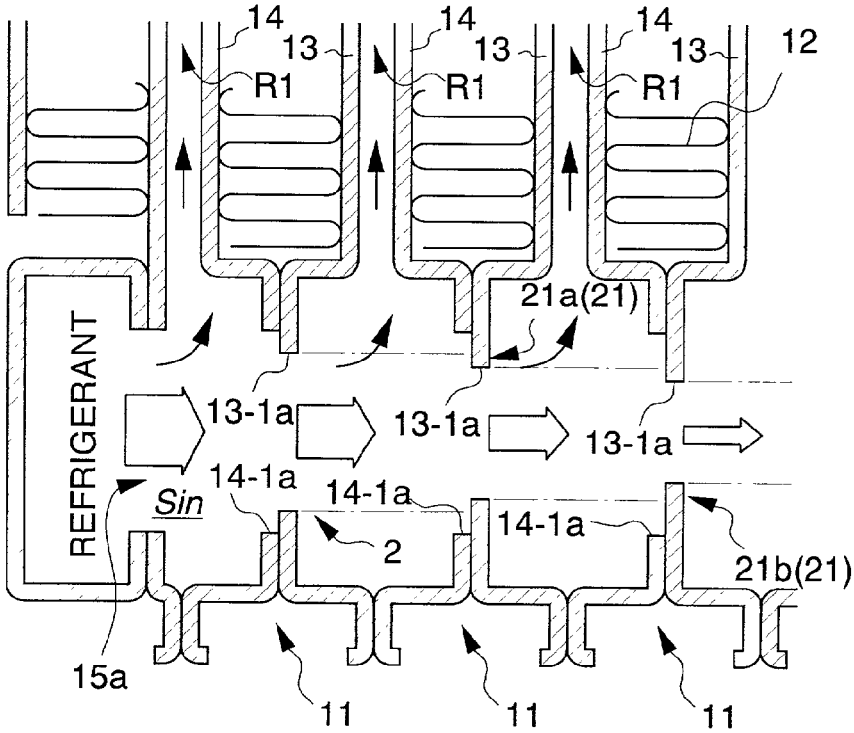
FIG. 7 is a modification of the present invention, and is a cross-sectional drawing showing the space at the entrance side and the refrigerant path connected thereto.

In the heat exchanger in the present example, as shown in FIG. 7, the opening 13-1*a* is formed as small as the baffle plate 21 positioned in the direction of flow of the refrigerant. For example, the part of the refrigerant that passes through the opening 13-1*a* of the baffle plate 21*a* on the upstream side cannot pass through the opening 13-1*a* because the flow is prevented by the baffle plate 21*b* when passing through the opening 13-1*a* of the adjacent baffle plate 21*b* in the downstream direction.

In this manner, because the openings 13-1*a* are formed increasingly smaller in the baffle plates 21 positioned further in the direction of flow of the refrigerant, the refrigerant can be distributed uniformly by all of the refrigerant distribution parts 11 provided in plurality.

In this manner, in the heat exchanger of the present example, the refrigerant flows through one side of the two refrigerant paths R1 and R2, and thus heating due to the stagnation of the refrigerant is prevented.

In addition, in the spaces Sin 1 and Sin 2 on the entrance side, even if the flow of the ow of the refrigerant is reversed, the heat is dissipated because of the refrigerant flowing through the space Sin 2 of the entrance side.

Furthermore, the refrigerant can be distributed more evenly in the refrigerant distribution part 11 because the refrigerant is distributed by the baffle plates 20 (21).

Figure 8:
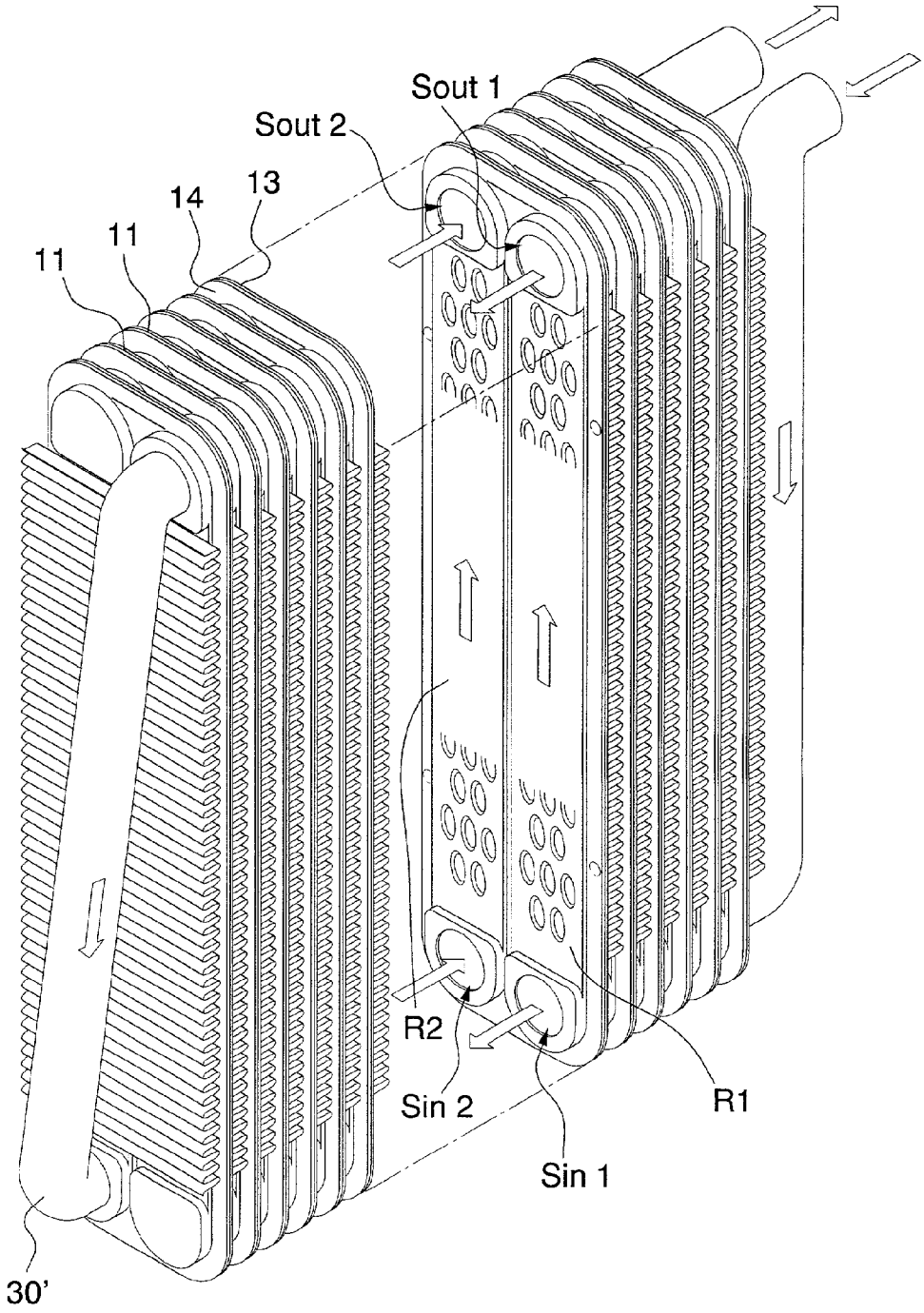
FIG. 8 is a perspective drawing viewing the heat exchanger shown as a modification of the present invention form the back.
Figure 9:
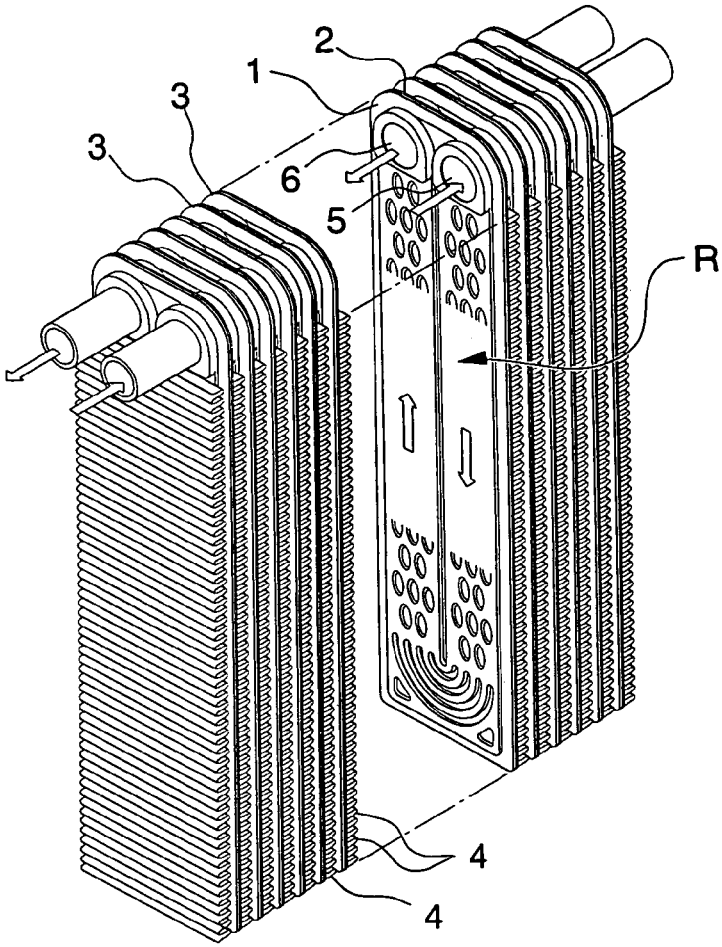
Prior Art Fig. 9
FIG. 9 is a perspective drawing showing an example of the conventional evaporator.
Figure 10:
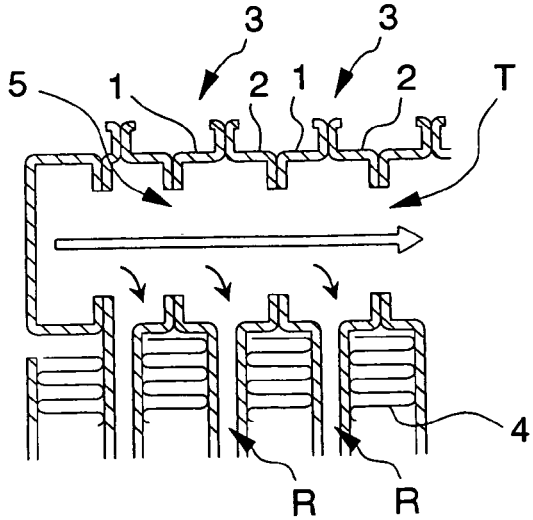
Fig. 10 Prior Art
FIG. 10 is a cross-sectional drawing showing the space the entrance side and the refrigerant path connected thereto in a conventional evaporator.

Moreover, as shown in FIG. 8, because the spaces Sin 1 and Sin 2 on the entrance side and the spaces Sout 1 and Sout 2 on the exit side are positioned adjacently to each other, the space Sout 1 on the exit side and space Sin 2 on the entrance side can be connected by the communicating path 30'.

As explained above, in the present invention, because the refrigerant flows through each of the sides in the refrigerant path, heating due to the stagnation of the refrigerant is prevented.

In addition, by providing a refrigerant distribution means, the refrigerant can be distributed more evenly.

What is claimed is:

1. A two-block heat exchanger including plate shaped refrigerant distribution parts comprising two overlapped plates that have been drawing processed and between which two separate refrigerant paths are formed, said distribution parts being alternatively layered with a refrigerant fin, at least one opening that opens into said refrigerant paths being respectively formed in each two plates of said refrigerant distribution parts, wherein:

said opening is provided at both respective ends of said refrigerant paths forming thereby, for each of said refrigerant paths of each of said distribution part, a refrigerant entrance and a refrigerant exit, a continuous refrigerant circulation space being formed by abutting said refrigerant entrances at the entrance side of respective refrigerant paths and a continuous refrigerant circulation space being formed by abutting said refrigerant exits at the exit side of respective refrigerant paths, and one end of each of said refrigerant circulating spaces is closed off and the other end is opened, the open end of said refrigerant circulation space at the exit side of one of said refrigerant paths being corrected to the open end of said refrigerant circulation space at the entrance side of said other refrigerant path, further comprising, in at least one of said refrigerant circulation spaces at the entrance side of said refrigerant paths, a baffle plate formed at the end of at least one of said two plates around said openings in order to prevent that all the refrigerant present in the refrigerant entrance positioned upstream said baffle plate flows into the refrigerant entrance positioned downstream said baffle plate, wherein each of said openings of said baffle plate is larger than the corresponding opening of an adjacent baffle plate in the direction of flow of the refrigerant and each of said openings of said baffle plate is disposed so as not to completely overlap the corresponding opening of the adjacent baffle plate.

2. The heat exchanger according to claim 1, wherein the refrigerant entrance of said one refrigerant path is provided adjacent to the refrigerant exit of said other refrigerant path and wherein a communicating path connects said open end of said refrigerant circulation space at the exit side of said one refrigerant path to the open end of said refrigerant circulation space at the entrance side of said other refrigerant path.

3. The heat exchanger according to claim 1, wherein the refrigerant entrance of said one refrigerant path is provided adjacent to the refrigerant entrance of said other refrigerant path and wherein a communicating path connects said open end of said refrigerant circulation space at the exit side of said one refrigerant path to the open end of said refrigerant circulation space at the entrance side of said other refrigerant path.

* * * * *